US009006627B2

(12) United States Patent
Do et al.

(10) Patent No.: US 9,006,627 B2
(45) Date of Patent: Apr. 14, 2015

(54) LIGHTING SYSTEM FOR USE WITH A MICROWAVE OVEN

(75) Inventors: Terry Lien Do, Louisville, KY (US); Bryan James Beckley, Louisville, KY (US); Kyle Robert Eden, Louisville, KY (US); Brian Michael Schork, Louisville, KY (US)

(73) Assignee: General Electric Company, Schenectady, NY (US)

( * ) Notice: Subject to any disclaimer, the term of this patent is extended or adjusted under 35 U.S.C. 154(b) by 783 days.

(21) Appl. No.: 12/986,094

(22) Filed: Jan. 6, 2011

(65) Prior Publication Data

US 2012/0175365 A1 Jul. 12, 2012

(51) Int. Cl.

| | |
|---|---|
| ***H05B 6/68*** | (2006.01) |
| ***F21V 33/00*** | (2006.01) |
| ***H05B 6/64*** | (2006.01) |
| *F21W 131/307* | (2006.01) |
| *F21Y 101/02* | (2006.01) |

(52) U.S. Cl.

CPC ..... *F21V 33/0044* (2013.01); *F21W 2131/307* (2013.01); *F21Y 2101/02* (2013.01); *H05B 6/6402* (2013.01)

(58) Field of Classification Search

CPC ..... F21V 33/0044; H05B 6/6402; F21Y 2101/02; F21W 2131/307

USPC ..... 219/758, 393, 704, 685, 763, 518, 502, 219/762, 705; 99/235, 451; 126/273 R; 362/552, 554, 556, 92

See application file for complete search history.

(56) References Cited

U.S. PATENT DOCUMENTS

| | | | | |
|---|---|---|---|---|
| 5,712,468 | A | 1/1998 | Ace | |
| 5,931,557 | A | 8/1999 | Danilychev | |
| 6,172,347 | B1 * | 1/2001 | Lee | 219/685 |
| 6,331,915 | B1 * | 12/2001 | Myers | 359/599 |
| 6,343,089 | B1 | 1/2002 | Manos et al. | |
| 6,486,594 | B1 | 11/2002 | Kang | |

FOREIGN PATENT DOCUMENTS

| | | | |
|---|---|---|---|
| JP | 63223423 A | * | 9/1988 |
| JP | 11351576 A | * | 12/1999 |

* cited by examiner

*Primary Examiner* — Quang Van

(74) *Attorney, Agent, or Firm* — GE Global Patent Operation; Marc A. Vivenzio

(57) ABSTRACT

A microwave oven includes a top wall, side walls, and a bottom wall at least partially defining a cavity of the microwave oven, and a table coupled to the bottom wall. The table has a top surface and an opposing bottom surface. The top surface is configured to support an item within the cavity. A light source directs light to the table. The table is configured to diffuse light emitted from the light source into the cavity.

8 Claims, 6 Drawing Sheets

LIGHTING SYSTEM FOR USE WITH A MICROWAVE OVEN

BACKGROUND OF THE INVENTION

The embodiments described herein relate generally to lighting systems within appliances and, more particularly, to lighting systems within microwave ovens.

At least some known microwave ovens include a light that illuminates a cavity of the microwave oven during heating of an item within the cavity and/or when a door of the microwave is opened. In such microwave ovens, a halogen lamp or an incandescent lamp is used to illuminate the cavity. However, known microwave oven lighting systems are not energy efficient and/or do not uniformly illuminate the cavity. For example, at least one known microwave oven lighting system includes a halogen lamp or an incandescent lamp positioned on a side wall or a top wall. As such, the lamp directs light into the cavity from the discrete location where the lamp is positioned.

BRIEF SUMMARY OF THE INVENTION

In one aspect, a microwave oven is provided. The microwave oven includes a top wall, side walls, and a bottom wall at least partially defining a cavity of the microwave oven, and a table coupled to the bottom wall. The table has a top surface and an opposing bottom surface. The top surface is configured to support an item within the cavity. A light source directs light to the table. The table is configured to diffuse light emitted from the light source into the cavity.

In another aspect, a mixer for use with an appliance lighting system is provided. The mixer includes at least one light source, at least one light directing surface positioned with respect to the at least one light source, and an outlet positioned with respect to a bottom wall of an appliance. The at least one light directing surface is configured to direct light from the at least one light source through the outlet.

In yet another aspect, a table for use with a lighting system is provided. The table includes a top surface, a bottom surface opposing the top surface, and at least one light directing surface defined between the top surface and the bottom surface. The at least one light directing surface is configured to direct light from a light source positioned below the bottom surface through the top surface.

BRIEF DESCRIPTION OF THE DRAWINGS

FIG. 1 is a perspective view of an exemplary microwave oven.

FIG. 2 is a schematic view of the microwave oven shown in FIG. 1.

FIG. 3 is a cross-sectional side view, taken along line 3-3 in FIG. 4, of an exemplary lighting system that may be used with the microwave oven shown in FIGS. 1 and 2.

FIG. 4 is a top view of the lighting system shown in FIG. 3.

FIG. 5 is a top view of a bottom portion that may be used with the lighting system shown in FIGS. 3 and 4.

FIG. 6 is cross-sectional side view, taken along line 6-6 in FIG. 1, of a table that may be used with the lighting system shown in FIGS. 3-5.

DETAILED DESCRIPTION OF THE INVENTION

The embodiments described herein use light emitting diodes (LEDs) in a table area of a microwave oven or an over-the-range microwave oven to illuminate an interior cavity of the microwave oven. A single LED or multiple LEDs are installed below a substantially light-transparent table, in a table motor, and/or within the table in the microwave oven. The light from the LEDs is preferably directed upwardly through at least a portion of the glass table for a uniform and even lighting appearance within the interior cavity. In one embodiment, the light is directed through the table and upwards toward a top wall of the cavity.

The lighting system described herein positively affects energy consumption and an appearance of a microwave oven. The LEDs consume less energy than conventional incandescent lamps and/or halogen lamps that are typically used in conventional microwave ovens and over-the-range microwave ovens. As a result, the LEDs in the herein-described embodiments provide energy savings for consumers. For appearance, the light produced by an LED can be more aesthetically-pleasing and/or cleaner than incandescent or halogen lighting. Further, the light produced by an LED can also be custom tailored to a particular application. For example, a white or a blue LED could be used to provide a cleaner appearance in the interior cavity of the microwave, as compared to the yellow glow that is produced by incandescent or halogen lamps.

Figure 1:
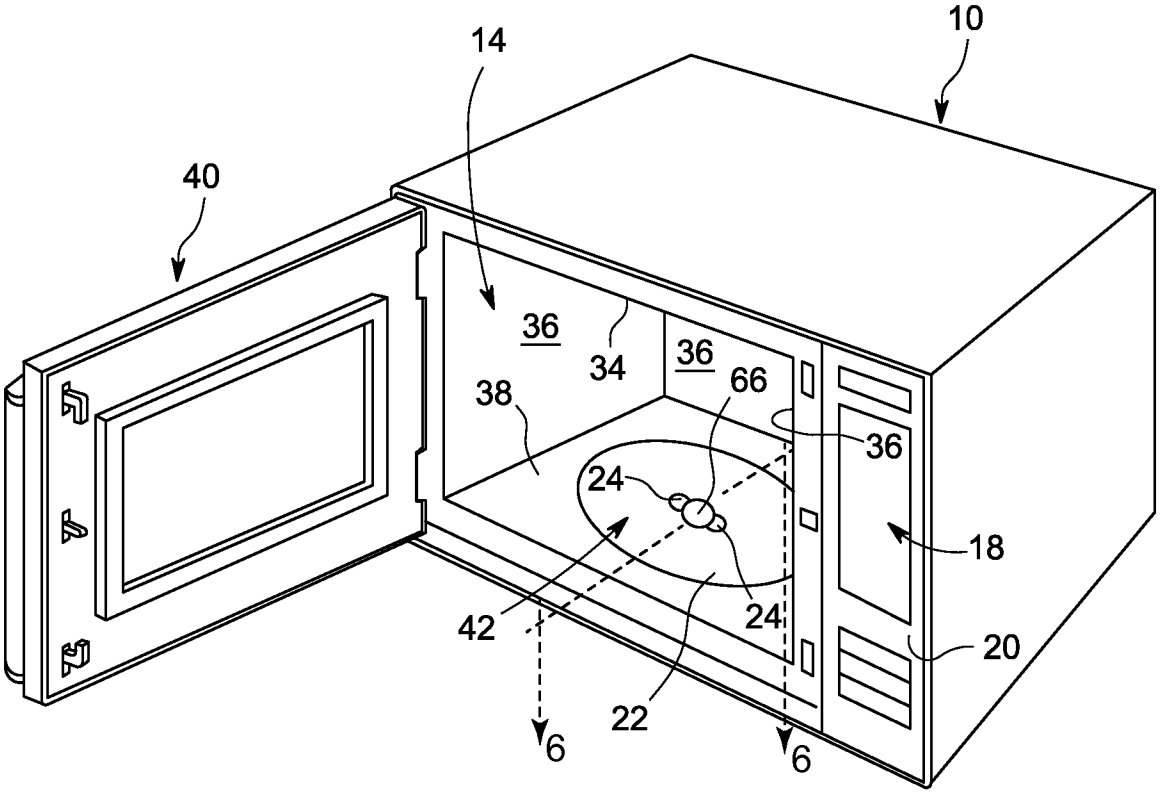
FIGS. 1-6 show exemplary embodiments of the systems and method described herein.
Figure 2:
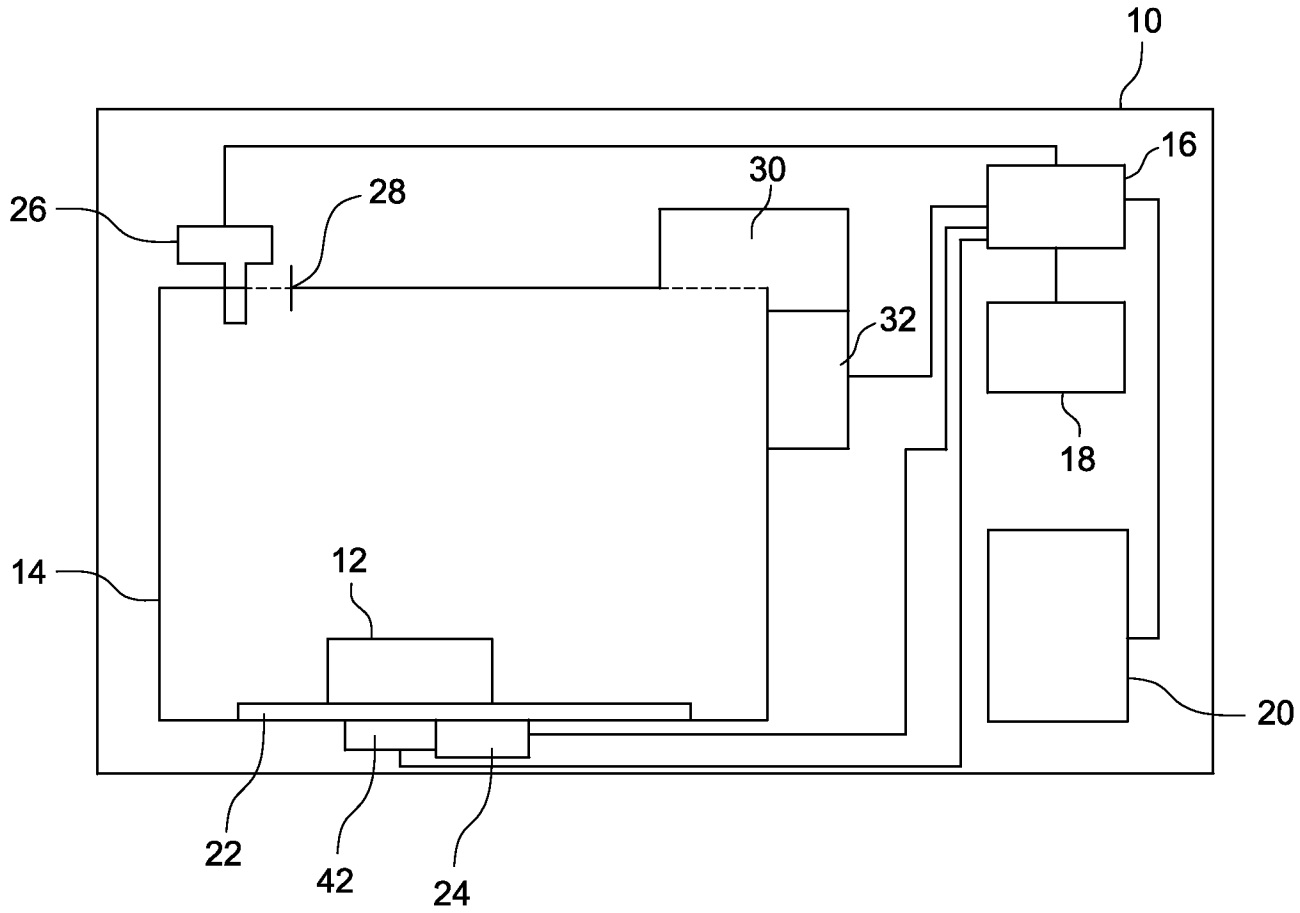

Referring now to the figures, FIG. 1 shows an exemplary microwave oven 10 having a lighting system to illuminate an item 12 (shown in FIG. 2), such as food or water, placed within a cavity 14 of microwave oven 10 for heating. FIG. 2 is a schematic view of microwave oven 10. Microwave oven 10 includes a controller 16, a display 18, a control panel 20, cavity 14, a table 22, a table motor 24, a sensor 26, a vent 28, a guide 30, and a generator 32 that generates microwaves. It is noted that in an alternative embodiment, any oven having a generator of microwaves, such as, a speedcooking oven, can be used instead of microwave oven 10. The term "controller" as used herein is not limited to just those integrated circuits referred to in the art as controllers, but broadly refers to controllers, processors, microcontrollers, microcomputers, programmable logic controllers, application specific integrated circuits, and other programmable circuits, and these terms are used interchangeably herein. Examples of display 18 include a light emitting diode (LED) display and a vacuum fluorescent display (VFD). An example of generator 32 includes a magnetron that generates microwaves. Controller 16 is communicatively coupled to display 18, control panel 20, table motor 24, sensor 26, and generator 32. As used herein, the term "communicatively coupled," or variations thereof, refers to a link, such as a conductor, a wire, and/or a data link, between two or more components of microwave oven 10 that enables signals, electric currents, and/or commands to be communicated between the two or more components. The link is configured to enable one component to control an operation of another component of microwave oven 10 using the communicated signals, electric currents, and/or commands.

Microwave oven 10 includes cavity 14 defined by a top wall 34, side walls 36, a bottom wall 38, and a door 40. A user places item 12 inside cavity 14 on table 22 for heating item 12. In the exemplary embodiment, table 22 is transparent or substantially transparent, as described in more detail below. The user uses control panel 20 to operate microwave oven 10. Control panel 20 provides various options to the user to heat item 12. As one example, the user uses control panel 20 to enter an amount of time for which the user desires to heat item 12. As another example, the user uses control panel 20 to enter a power level at which the user desires to heat item 12. As yet another example, the user uses control panel 20 to enter the type of item 12 that the user desires to heat. Display 18 shows the user one or all of the various options that the user selects using control panel 20. As an example, display 18 shows the time for which the user desires to heat item 12 and a countdown of the time as item 12 is being heated. As another example, display 18 shows the power level at which the microwave oven 10 operates. As yet another example, display 18 shows whether item 12 is being simmered, cooked, boiled, or baked.

During operation of microwave oven 10, generator 32 generates microwaves which are delivered to cavity 14 via guide 30. A cooling fan (not shown) cools generator 32. Item 12 is heated by energy of the microwaves, which can cause moisture to leave item 12 into the air within cavity 14. Sensor 26 provides a signal, such as a voltage signal or a current signal, to controller 16. The signal corresponds to a level of humidity inside cavity 14, which is measured when moisture content of air inside cavity 14 is being exhausted via vent 28. Controller 16 receives the signal from sensor 26 and controls power level of generator 32 during operation of microwave oven 10. Controller 16 can further control a rotation of table 22 via table motor 24. In the exemplary embodiment, table 22 rotates while item 12 is being heated. Further, controller 16 controls a lighting system 42 to illuminate cavity 14 when door 40 is open and/or when item 12 is being heated and/or in response to actuation by the user of a manually actuatable light switch disposed on control panel 20.

Figure 3:
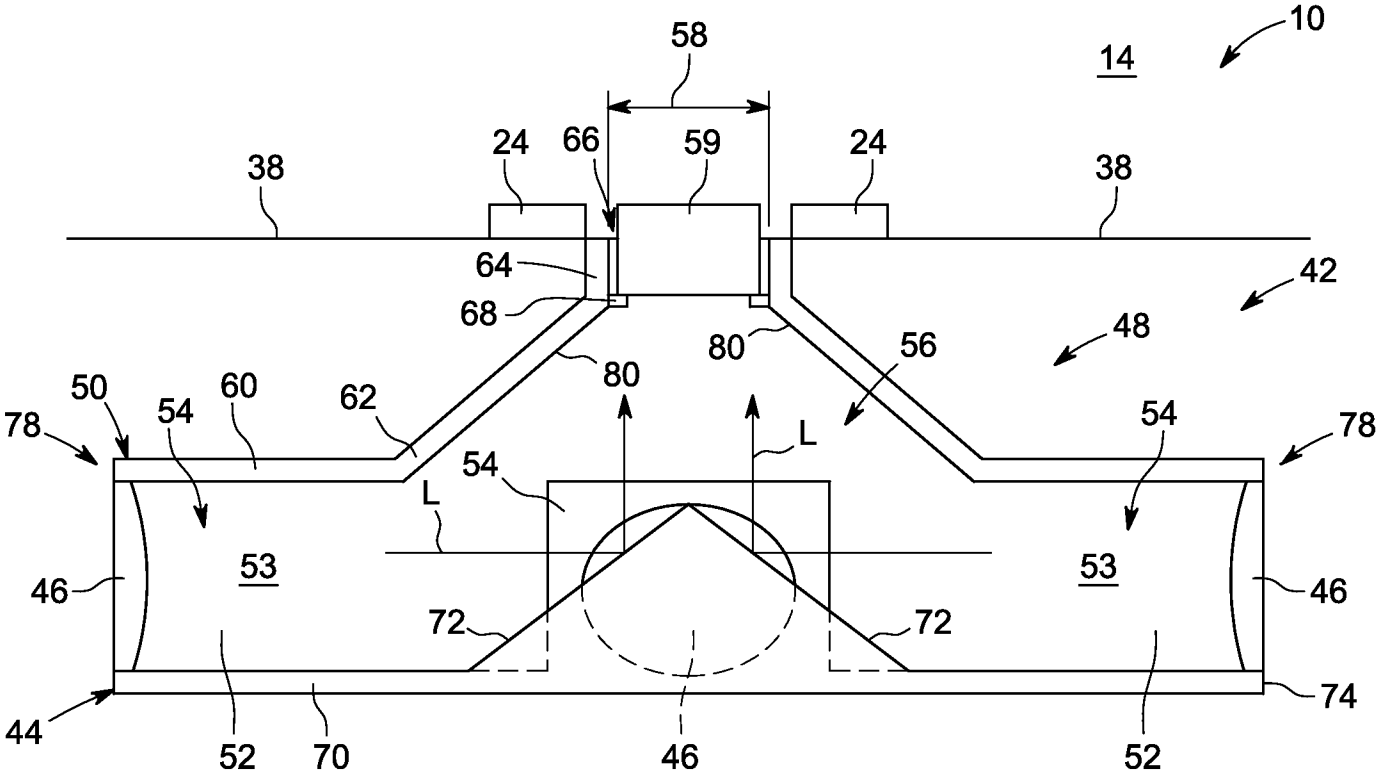
Figure 4:
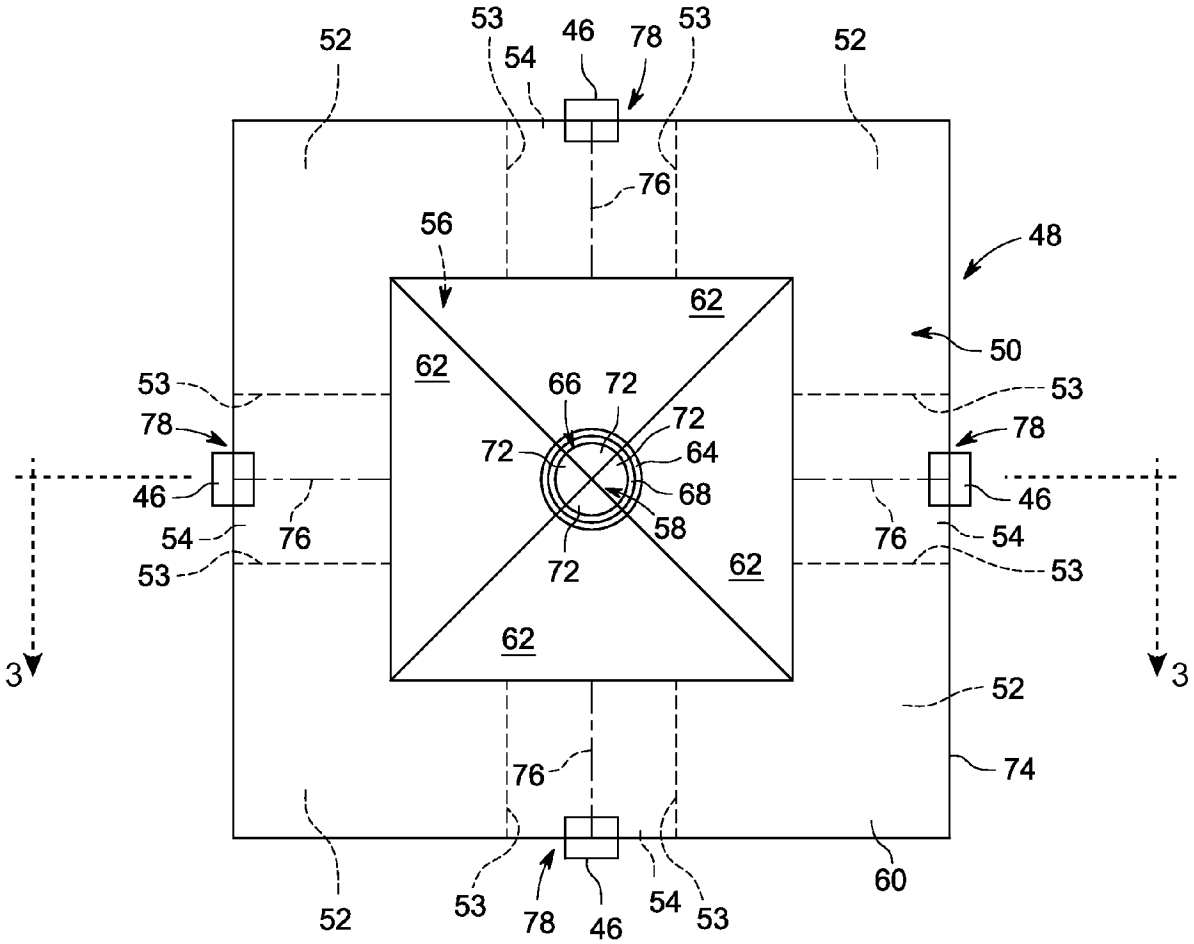
Figure 5:
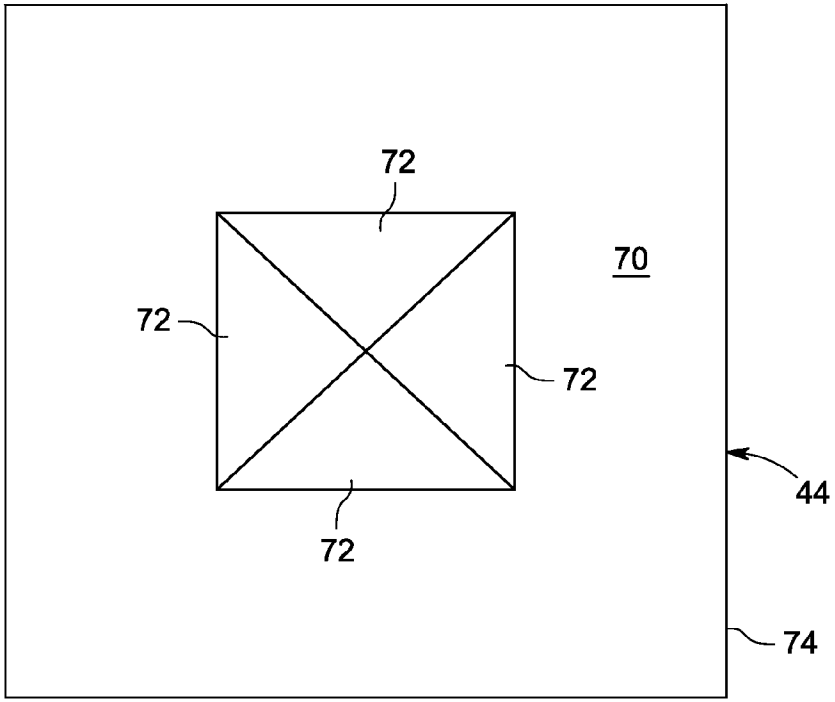
Figure 6:
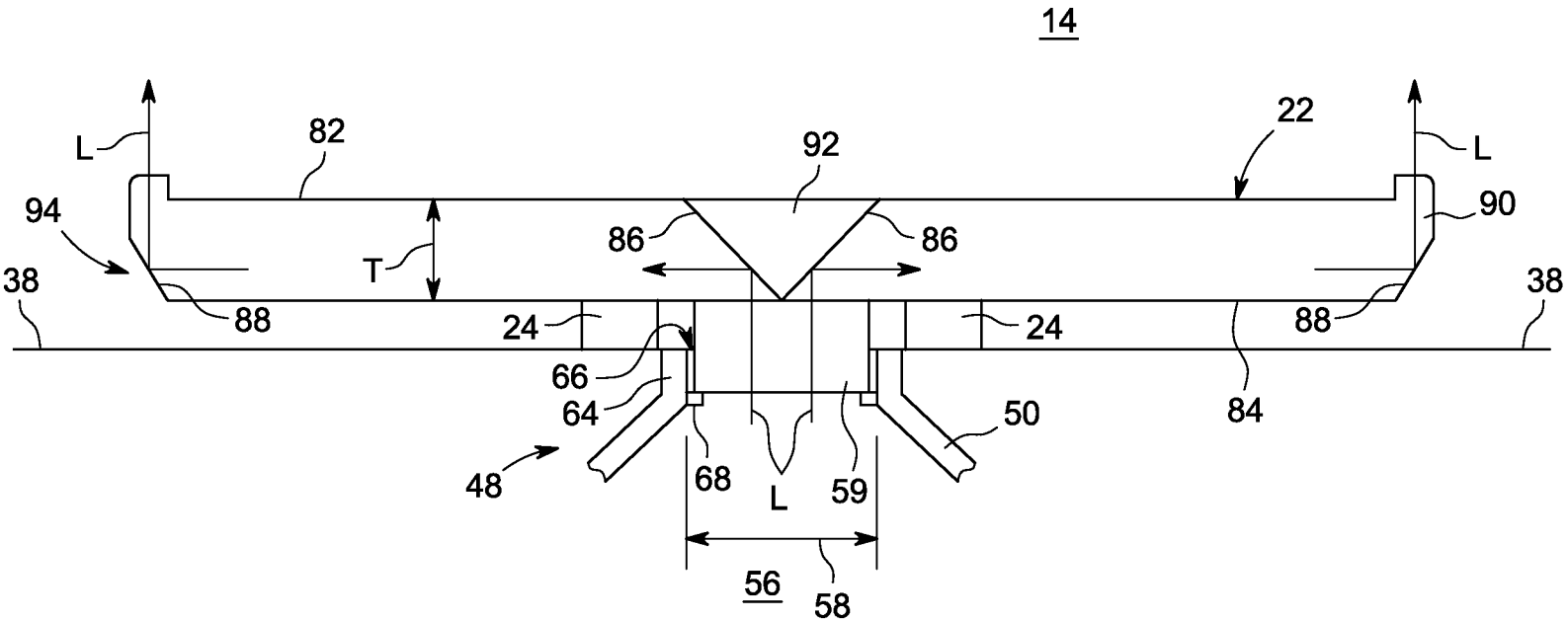

FIG. 3 is a cross-sectional side view of an exemplary lighting system 42 that may be used with microwave oven 10 (shown in FIGS. 1 and 2). FIG. 4 is a top view of lighting system 42. FIG. 5 is a top view of a bottom portion 44 that may be used with lighting system 42, and FIG. 6 is a cross-sectional side view of table 22. In FIGS. 3 and 6, arrows L represent a direction of light transmitted through lighting system 42. In the exemplary embodiment, four light sources 46 are used with lighting system 42; however, it should be understood that any suitable number of light sources 46, including one light source 46, can be used with lighting system 42. Light source 46 directs light from a bottom surface 84 of table 22 toward a top surface 82 of table 22.

In the exemplary embodiment, lighting system 42 includes light sources 46 and a mixer 48. When one light source 46 is used, mixer 48 can be omitted or configured to direct light emitted from the one light source 46. Mixer 48 can be formed of any suitable material, such as a metal, a plastic, and/or a glass. For example, mixer 48 is formed from any material that reflects and/or directs light as described herein. In the exemplary embodiment, mixer 48 is formed from a plastic material, such as polycarbonate or acrylic, and includes bottom portion 44, a top portion 50, and side portions 52. In FIG. 4, side portions 52 are positioned below top portion 50 and are shown in hidden. Side portions 52 are solid and/or at least partially hollow portions of material that are positioned between bottom portion 44 and top portion 50 to define side walls 53. Side portions 52 can be integrally formed as one piece with bottom portion 44 and/or top portion 50 and/or coupled to bottom portion 44 and/or top portion 50. As used herein, the term "coupled to," or variations thereof, refers to a direct or an indirect connection and/or coupling between at least two components of microwave oven 10. Bottom portion 44, top portion 50, and side portions 52 define channels 54, a mixing chamber 56, and an outlet 58.

In the exemplary embodiment, a light pipe 59 is coupled to mixer 48 to direct light into table 22, as described in more detail below. More specifically, light pipe 59 extends from mixer 48, through table motor 24, to table 22. In the exemplary embodiment, light pipe 59 is coupled to mixer 48 at outlet 58 and is at least partially surrounded by a substantially vertical wall 64. Light pipe 59 is positioned adjacent to, coupled to, or integrally formed with table 22. Further, light pipe 59 is formed from a light transmitting material, such as acrylic, optically clear glass, polycarbonate, and/or any other suitable material.

Top portion 50 includes, in the exemplary embodiment, a substantially horizontal wall 60, converging side walls 62, and substantially vertical wall 64. Horizontal wall 60 is spaced apart from bottom portion 44 and defines top walls of channels 54. Side walls 62 converge from horizontal wall 60 toward vertical wall 64 to define mixing chamber 56. In the exemplary embodiment, side walls 62 form a generally pyramidal shape between horizontal wall 60 and vertical wall 64; however, it should be understood that side walls 62 can have any suitable configuration that enables lighting system 42 to function as described herein. Vertical wall 64 is, in the exemplary embodiment, substantially circular and defines outlet 58. Vertical wall 64 also defines a top aperture 66 of mixer 48, which, in the exemplary embodiment, is an aperture defined though bottom wall 38. Although vertical wall 64 is circular in the exemplary embodiment, vertical wall(s) can have any suitable shape that enables lighting system 42 to function as described herein. In the exemplary embodiment, a collar 68 extends inward from vertical wall 64 adjacent a top end of side walls 62. Collar 68 supports light pipe 59 within mixer 48 and/or prevents light pipe 59 from being inserted too far into outlet 58 and/or mixing chamber 56.

Bottom portion 44 includes a substantially horizontal wall 70 and a plurality of light directing surfaces 72. Horizontal wall 70 defines bottom walls of channels 54 and of mixer 48. Light directing surfaces 72 extend upward from horizontal wall 70 at any suitable angle to direct light from a channel 54 toward mixing chamber 56 and/or outlet 58. Each light directing surface 72 is formed integrally as one piece with horizontal wall 70 and/or is coupled to horizontal wall 70. In the exemplary embodiment, a light reflecting surface 72 is associated with each channel 54 to direct light emitted from each light source 46. As shown in FIGS. 3-5, light directing surfaces 72 form a generally pyramidal shape corresponding to a shape formed by side walls 62. It should be understood that light directing surfaces 72 can have any suitable configuration that enables lighting system 42 to function as descried herein. In the exemplary embodiment, each light directing surface 72 is formed from a light directing material and/or includes a light directing coating. For example, a polished aluminum, a polishable metal, a mirror-type material, a reflective surface, and/or a gloss nickel can be used as the light directing coating.

Side portions 52 define side walls 53 of channels 54. More specifically, side portions 52 are positioned between bottom portion 44 and top portion 50 to at least partially defined channels 54. In the exemplary embodiment, channels 54 are oriented at substantially right angles to an outer periphery 74 of mixer 48. As such, two channels 54 are substantially parallel to each other and substantially perpendicular to the other two channels 54. When lighting system 42 includes other than four light sources 46, channels 54 are arranged differently to correspond to the number of light sources 46 and/or to a geometry of mixer 48. In the exemplary embodiment, a longitudinal axis 76 of each channel 54 is aligned to intersect with a respective light directing surface 72. As such, when light source 46 is positioned at an outer end 78 of channel 54, light is directed through channel 54 toward light directing surface 72 and directed upwardly into mixing chamber 56 and/or outlet 58. It should be understood that light source(s) 46 can be at any suitable position with respect to channel 54 and/or mixer 48 that enables lighting system 42 to function as described herein, and the description of mixer 48 set forth herein is not intended to limit lighting system 42.

In the exemplary embodiment, mixing chamber 56 is configured to direct light from light directing surfaces 72 toward outlet 58. In the exemplary embodiment, at least an inner surface 80 of side walls 62 includes a light directing coating. Alternatively, side walls 62 are formed from a light directing material. Outlet 58 extends upward from mixing chamber 56 to direct light from mixer 48 through top aperture 66 and/or light pipe 59. In the exemplary embodiment, top aperture 66 is substantially planar with a top surface of bottom wall 38 of microwave oven 10. Outlet 58, light pipe 59, and/or top aperture 66 have any suitable configuration that enables lighting system 42 to function as described herein.

A light source 46 is positioned within and/or adjacent outer end 78 of each channel 54. Alternatively, light sources 46 are positioned at any suitable locations within mixer 48. In the exemplary embodiment, each light source 46 is a light-emitting diode (LED), such as a 1 Watt LED, directed upwards towards top wall 34 of cavity 14 via light directing surfaces 72, mixing chamber 56, light pipe 59, and/or table 22. Light sources 46 are driven by a constant current regulator (not shown) and/or a constant voltage source (not shown) with a current limiting resistor (not shown) to prevent over-driving light source 46 and/or reducing an operating life of light source 46. When multiple light sources 46 are used in lighting system 42, lighting sources 46 are connected electrically in series with each other using a constant current source (not shown) and/or connected electrically in parallel with each other with the constant voltage source and the current limiting resistor.

Referring to FIG. 6, table 22 is coupled to bottom wall 38 via table motor 24. Alternatively, microwave oven 10 does not include table motor 24 and table 22 is not automatically rotatable with respect to bottom wall 38. In the exemplary embodiment, table 22 includes a top surface 82 and an opposing bottom surface 84. Item 12 is supported on top surface 82. Table 22 is formed from a substantially transparent material, such as acrylic, optically clear glass, and/or polycarbonate using any suitable method and/or technique. Table 22 includes at least one light directing surface configured to direct light from light source 46, aperture 66, and/or light pipe 59 through a surface of table 22 to illuminate cavity 14. More specifically, table 22 is configured to diffuse light emitted from light source 46 and/or aperture 66 to illuminate cavity 14. Although a specific embodiment of table 22 is described herein, it should be understood that table 22 includes any suitable configuration that enables light to be directed from light source 46 into cavity 14. In one embodiment, a configuration of the at least one light directing surface is based on total internal reflection of light within table 22 using, for example, properties of a material used to construct table 22 and/or an air-to-material boundary.

In the exemplary embodiment, table 22 includes central light directing surfaces 86 and peripheral light directing surfaces 88. Central light directing surfaces 86 are substantially cone shaped, with a top point of the cone directed downwardly. It should be understood that central light directing surfaces 86 can have any suitable configuration that directs light from outlet 58 toward a peripheral edge 90 of table 22. A portion 92 of table 22 within central light directing surfaces 86 can be integrally formed with table 22 or can be an insert coupled to table 22.

Peripheral light directing surfaces 88 at least partially circumscribe, and may substantially circumscribe, a peripheral edge of table 22. In the exemplary embodiment, peripheral light directing surfaces 88 substantially circumscribe a bottom corner edge 94 of table 22. Peripheral light directing surfaces 88 are configured to direct light from central light directing surfaces 86 toward top wall 34 of cavity 14. As such, peripheral light directing surfaces 88 generate a ring of light about table 22. Alternatively, additional light directing surfaces defined within table 22 can direct light from table 22 at any suitable location. The ring of light generated by peripheral light directing surfaces 88 avoids directing light from table 22 at locations that are usually under item 12 (shown in FIG. 2) being heated. Notably, a thickness T of table 22 is related to a diameter of outlet 58 and a length of light travel through light pipe 59 using any suitable optics equations and/or relationships.

In the exemplary embodiment, mixer 48 is configured to direct light into table 22 through table motor 24; however, aperture 66 can be at any suitable location with respect to table 22. Further, microwave oven 10 can include any suitable number of apertures 66. For example, when mixer 48 is omitted, lighting system 42 includes a plurality of light sources 46 positioned below bottom wall 38, and each light source 46 is positioned adjacent a respective aperture through bottom wall 38. In still another embodiment, lighting system 42 includes a plurality of mixers 48 positioned below bottom wall 38 and each having a respective aperture 66. In yet another embodiment, one mixer 48 includes a plurality of apertures 66 through bottom wall 38. Any or none of aperture 66 include light pipe 59 extending therethrough. In an alternative embodiment, light source 46 is integrated into table 22 and/or table motor 24. When light source 46 is integrated into table 22, light source 46 is positioned below top surface 82 of table 22 to enable item 12 to be supported on top surface 82.

Referring to FIGS. 1-6, microwave oven 10 includes cavity 14 at least partially defined by top wall 34, side walls 36, and bottom wall 38 is provided. Table 22 is coupled to bottom wall 38 within cavity 14. More specifically, table motor 24 is coupled to bottom wall 38, and table 22 is coupled to table motor 24. Table motor 24 is positioned with respect to aperture 66 and/or light pipe 59 to enable light to be emitted through table motor 24 to table 22. At least one light directing surface 86 and/or 88 is defined within table 22. Light directing surface 86 and/or 88 is configured to direct light from light source 46 though table 22. More specifically, in the exemplary embodiment, central light directing surface 86 configured to direct light from light source 46 toward peripheral edge 90 of table 22 is defined in table 22. Further, peripheral light directing surface 88 configured to direct the light from central light directing surface 86 toward top wall 34 of cavity 14 through top surface 82 of table 22 adjacent peripheral edge 90 of table 22 is defined in table 22.

Light source 46 is coupled below top surface 82 of table 22 and is configured to emit light toward table 22. Table 22 is configured to diffuse the light from light source 46 into cavity 14. More specifically, aperture 66 is defined through bottom wall 38, and light source 46 is coupled below bottom wall 38 to emit light through aperture 66 to table 22. In the exemplary embodiment, mixer 48 is coupled below bottom wall 38 of cavity 14, and light pipe 59 is coupled to mixer 48. Mixer 48 includes at least one channel 54, at least one light directing surface 72 positioned with respect to at least one channel 54, and outlet 58 that defines aperture 66 within bottom wall 38. Further, light source 46 is coupled with respect to channel 54. Light source 46 is positioned to direct light through channel 54 to light directing surface 72, and light directing surface 72 is configured to direct light from light source 46 through outlet 58 and/or into mixing chamber 56. When one light source 46 is used in lighting system 42, light directing surface 72 can be omitted.

When lighting system 42 includes a plurality of light sources 46, mixer 48 includes a plurality of channels 54 and a plurality of light directing surfaces 72 each positioned with respect to one channel 54. Light sources 46 are coupled at least partially within mixer 48. More specifically, each light source 46 is positioned at least partially within a respective channel 54. Mixing chamber 56 is defined within mixer 48 between light directing surfaces 72 and outlet 58. Mixing chamber 56 is configured to combine light from light sources 46 before emitting combined light from outlet 58 and/or light pipe 59.

During operation of microwave oven 10, controller 16 activates light sources 46 upon occurrence of a predetermined event, such as opening of door 40 and/or heating of item 12. Upon activation, light sources 46 direct light through channels 54 toward light directing surfaces 72. Light directing surfaces 72 direct light into mixing chamber 56 and/or through outlet 58. Within mixing chamber 56, the light from light sources 46 is combined and directed from mixer 48 though outlet 58. As the combined light passes through aperture 66, the light is directed into table 22 via light pipe 59. The light interacts with central light directing surfaces 86 and is directed through table 22 toward peripheral edge 90. Near peripheral edge 90, the light interacts with peripheral light directing surfaces 88 and is directed upward from top surface 82 of table 22. The light is directed upward from table 22 at least adjacent to peripheral edge 90; however, the light can be directed from table 22 at any suitable location by defining light directing surfaces on a surface of or within table 22.

The lighting system described above provides a microwave oven lighting system that consumes less energy than conventional incandescent and/or halogen lighting systems used in conventional microwave ovens. More specifically, the above-described lighting system includes at least one LED that emits light directed through a table that acts as a light guide and/or a light diffuser. Further, the embodiments described above provide a light mixer for use with a plurality of LEDs. The light mixer acts as a light pipe that combines the light emitted from the LEDs and directs the combined light through a shared aperture. As such, the above-described mixer enables lower-power LEDs to be used within the lighting system. Further, the positioning of the LEDs below a bottom wall of a cavity provides protection from microwave radiation for the LEDs.

Exemplary embodiments of a lighting system for use with a microwave oven is described above in detail. The system is not limited to the specific embodiments described herein, but rather, components of systems may be utilized independently and separately from other components described herein. For example, the lighting system may also be used in combination with other appliance systems, and is not limited to practice with only the microwave oven systems as described herein. Rather, the exemplary embodiment can be implemented and utilized in connection with many other lighting applications.

Although specific features of various embodiments of the invention may be shown in some drawings and not in others, this is for convenience only. In accordance with the principles of the invention, any feature of a drawing may be referenced and/or claimed in combination with any feature of any other drawing.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

What is claimed is:

1. A microwave oven comprising:

a top wall, side walls, and a bottom wall at least partially defining a cavity of said microwave oven, the bottom wall defining an aperture therethrough;

a table coupled to the bottom wall, the table having a top surface and an opposing bottom surface, the top surface configured to support an item within said cavity;

a mixer defining a mixing chamber formed in part by a bottom portion, the bottom portion defining a plurality of light directing surfaces extending outwardly therefrom, the mixing chamber defined in part by a plurality of channels, a longitudinal axis of each channel being aligned to intersect with one of the plurality of light directing surfaces, the mixing chamber further defining an outlet aligned with the aperture in the bottom wall of the microwave oven;

a plurality of light sources, each light source positioned within or adjacent an outer end of each of the plurality of channels; and the mixer configured to allow light from the light sources to pass through the corresponding channels towards the light directing surface and reflect through the outlet through said table, said table configured to diffuse the light emitted from said plurality of light sources into said cavity to illuminate said cavity.

2. A microwave oven in accordance with claim 1, wherein said light source comprises a light-emitting diode.

3. A microwave oven in accordance with claim 1, wherein said table comprises at least one central light directing surface aligned with said outlet; said at least one central light directing surface configured to direct light from said light source toward a peripheral edge of said table.

4. A microwave oven in accordance with claim 1, wherein said mixer further comprises:

a top portion comprising said outlet; and side portions positioned between said bottom portion and said top portion, said side portions at least partially defining side walls of said plurality of channels.

5. A microwave oven in accordance with claim 1 further comprising a light pipe positioned within said outlet and configured to direct light from said mixer through said outlet.

6. A microwave oven in accordance with claim 1, wherein the table further comprises at least one light directing surface defined between said top surface and said bottom surface, said at least one light directing surface configured to direct light from the plurality of light sources through said top surface.

7. A microwave oven in accordance with claim 6, wherein said at least one light directing surface comprises a peripheral light directing surface that at least partially circumscribes a peripheral edge of said table and is configured to direct light upwardly from the peripheral edge.

8. A microwave oven in accordance with claim 1, wherein the table comprises at least one of acrylic, optically clear glass, and polycarbonate.

* * * * *